United States Patent [19]

Will et al.

[11] 3,990,233

[45] Nov. 9, 1976

[54] REACTOR FOR AFTERBURNING OF UNBURNED CONSTITUENTS IN THE EXHAUST OF AN INTERNAL COMBUSTION ENGINE

[75] Inventors: Peter Will, Bad Rappenau; Gottlieb Wilmers, Neuenstadt; Hermann Harst, Neckarsulm, all of Germany

[73] Assignee: Audi NSU Auto Union Aktiengesellschaft, Neckarsulm, Wurtt, Germany

[22] Filed: Mar. 21, 1975

[21] Appl. No.: 560,974

[30] Foreign Application Priority Data

Aug. 30, 1974 Germany ..... 2441655
Mar. 27, 1974 Germany ..... 2414726

[52] U.S. Cl. ..... 60/282; 60/322; 60/323

[51] Int. Cl.² ..... F01N 3/10

[58] Field of Search ..... 60/307, 290, 282, 322, 60/323; 23/277 C

[56] References Cited

UNITED STATES PATENTS

| | | | |
|---|---|---|---|
| 2,608,819 | 9/1952 | Moorehead | 60/322 |
| 3,703,083 | 11/1972 | Tadokoro | 60/322 |
| 3,788,070 | 1/1974 | Camarasa | 60/290 |
| 3,805,523 | 4/1974 | Tanasawa | 60/307 |
| 3,898,802 | 8/1975 | Tadokoro | 60/322 |
| 3,902,853 | 9/1975 | Marsee | 60/322 |

*Primary Examiner*—Douglas Hart
*Attorney, Agent, or Firm*—Kane, Dalsimer, Kane, Sullivan and Kurucz

[57] ABSTRACT

The invention concerns a reactor for afterburning of unburned constituents in the exhaust of an internal combustion engine, consisting of a jacketed heat-insulated reactor chamber into which at least one inlet pipe passing through the jacket and communicating with an outlet passage of the engine opens tangentially, being traversed by exhaust gases mixed with secondary air, and having an outlet pipe for escape of exhaust gases from the reactor chamber. The reactor chamber in cylindrical in shape and the inlet pipe opens into the reactor chamber tangentially and the outlet pipe is passed out of the reactor chamber tangentially from the inlet pipe in the direction offset of flow.

3 Claims, 6 Drawing Figures

REACTOR FOR AFTERBURNING OF UNBURNED CONSTITUENTS IN THE EXHAUST OF AN INTERNAL COMBUSTION ENGINE

BACKGROUND OF THE INVENTION

In order to achieve as complete afterburning as possible of the injurious constituents of exhaust gases of internal combustion engines, and to obtain an effective reaction in the combustion chamber of such a reactor, thorough mingling of the exhaust with the secondary air supplied and a sufficiently long reaction zone with low flow resistance are required. However, especially with the limited space generally available to accommodate a reactor, these requirements are not so easily satisfied.

In one known embodiment of a reactor (Public Disclosure No. 1,300,129), the reactor chamber has been divided, by means of a partition having a central hole, into a combustion chamber supplied with secondary air and an afterburning chamber with tangential outlet. Supply of secondary air directly into the combustion chamber, however, in order to secure an adequately effective reaction zone, requires a correspondingly large size of reactor, while the partition may give rise to unwanted flow resistance and increased backpressure, with possible resulting loss of engine output. Furthermore, the reaction, taking place especially at the partition owing to the impinging flow of exhaust, may impair its long-term durability.

SUMMARY OF THE INVENTION

The object of the invention is to provide a compact thermal reactor affording prolonged exhaust gas residence and thorough mingling with secondary air but low flow resistance.

This object is achieved, according to the invention, in that the shape of the reactor chamber is cylindrical and the inlet pipe opens into the reactor chamber tangentially in a conventional manner, with the outlet pipe passing out of the reactor chamber tangentially, being offset relative to the inlet pipe in flow direction. This arrangement enables the reactor chamber to be placed considerably closer to the inlet pipe, so that the flow of exhaust, impinging directly on the wall of the reactor chamber by virture of the tangential direction thus established and brought into gyrating motion in direct contact along it, is able to heat the walls of the reactor chamber especially rapidly. On the other hand, the vortex motion of the incoming exhaust thus set up will at the same time serve to mingle the exhaust gases with conventionally supplied secondary air in a manner especially suitable for afterburning, within a comparatively small volume. With retention of the gyrating direction of flow, finally, the afterburning exhaust gases will escape through the outlet pipe unimpeded with but little flow resistance. But owing to the offset arrangement of the exhaust pipe, the flow of exhaust can advantageously first be guided into a helical path, thus prolonging the residence of the exhaust in the reactor chamber, and achieving an adequately prolonged reaction zone for heavier, as yet incompletely oxidized exhaust, and the secondary air supply. The reaction chamber can therefore consist of a smooth-walled cylindrical interior of simple design.

In a reactor for an internal combustion engine having two outlet passages, the inlet pipes can enter the reactor chamber tangentially side by side in axial direction thereof. In this arrangement, affording an especially compact installation close to the engine, the several streams of exhaust will thus impinge simultaneously by the shortest route and within a suitably wide area on the wall of the reactor chamber, with the result that the reactor will heat up very rapidly as desired. Similarly, the exhaust can be very quickly set swirling so as to promote the reaction without traversing any great distance.

To achieve prolonged residence and thorough mingling of the exhaust with the secondary air generally supplied, it is expedient to arrange the tangential outlet pipe of the reactor chamber more or less between the two inlet pipes. Thus the exhaust gas to be afterburned will necessarily execute several helical gyrations along the wall inside the reactor chamber, so that the heavy constituents of the exhaust and the oxygen admixture are able to react before escaping through the outlet pipe.

According to the space available for housing the reactor in an engine, another conceivable embodiment for an internal combustion engine with two outlet passages has inlet pipes tangentially entering the reactor chamber successively in circumferential direction of the chamber. The consequent intensified flow of incoming exhaust can result in an accelerated gyration and contribute to still more intensive mingling with secondary air, a prolonged residence of the exhaust being obtainable in this embodiment as well, owing to the outlet pipe offset from the inlet pipes in the direction of flow.

Since, when a reactor of the above type is arranged especially close to the engine, a tangential insertion of the inlet pipes aimed at the wall of the reactor chamber may not be feasible in all cases, it is proposed that at least one inlet pipe be incorporated in the reactor chamber in the form of an arc opening tangentially into it. Such an arc, for example in the shape of a pipe bend, can guide the incoming exhaust tangentially to set up a gyrating vortex in the reactor chamber.

In this relatively compact construction, however, owing to temperature differences between the jacket and the heat-insulated reactor chamber, to avoid the potential hazard of stresses occurring and causing damage to the reactor chamber and the inlet pipes, one of the two inlet pipes can be composed of two segments end-to-end, one connected to the jacket and the other to the reactor chamber, and both sealed together by a sleeve movably overlapping the two segments. This permits the reactor chamber to move without stress in the event of thermal strain in the vicinity of the inlet pipes.

According to this proposal, the segment connected to the reactor chamber is free to move independently in relation to the segment connected to the jacket, thus accommodating the thermal expansion of the chamber relative to the jacket, so that no stresses will be set up in the reactor. The sleeve, a movable member of the inlet pipe, bridging the two segments, will prevent escape of exhaust gases with relative mobility, and provide uninterrupted thermal protection of the exhaust-carrying parts from the jacket.

To provide a universally movable but sealing connection between the segments and the sleeves, the two segments are rolled outward at their facing ends, the outer periphery of the rolled ends being in contact with the inside wall of the sleeve. The rolling of the segment ends into a toroidal shape serves to form an articulation between the segments and the sleeve. The toroidal shape has the further advantage of preventing deformation of the ends in case of temperature displacements of the reactor chamber between the sleeve and the two segments, thus ensuring a sealing contact at all times. Sealing yet movable contact of the segments with the sleeve can be maintained for the additional reason that the segments of the inlet pipe are subject to more intense heating when the engine is running than the sleeve and will therefore expand further, thus increasing the contact pressure.

At the end fitting over the segment connected to the jacket, the sleeve may be of smaller diameter than the outside diameter of the rolled end of the segment. This measure will keep the sleeve from slipping off the two ends of the segments and thereby interrupting both its sealing function and that of thermal protection from surrounding parts.

To enable the exhaust to be supplied in known manner with the oxygen required for afterburning of unburned constituents, each inlet pipe of the reactor chamber is provided with a connection for secondary air. Supply of secondary air at this point, namely at the inlet pipe, has been made possible because thorough mingling with the exhaust is obtainable with the proposed reactor types, owing to the intensity of swirling motion. In fact, utilizing the negative pressure waves of the incoming exhaust gases in the inlet pipes, provision can be made for self-aspiration of secondary air, with suitable arrangement of known check valves in the inlet pipe. This arrangement serves to eliminate the air pump and its costly accessories, formerly required to mingle the exhaust gases with secondary air, and supplying secondary air to the outlet passage of the engine, or to the vicinity of the outlet parts. Thanks to the early supply of secondary air to the inlet pipe, where it begins immediately to mingle with the exhaust, the reaction can also set in early, prior to entering the reactor chamber.

Owing to the proposed arrangements, with secondary air aspirated by the incoming exhaust gases at the inlet pipes themselves, reaction of the combustible constituents of the exhaust with the secondary air can set in very rapidly and be carried on with thorough mingling inside the reactor chamber as a result of the intensive swirling set up by the tangential inlet passages, the exhaust gases being able to gyrate along the walls of the reactor chamber unimpeded all the way to the outlet pipe without having to overcome much flow resistance, and thus achieving a prolonged residence and/or a long reaction zone.

BRIEF DESCRIPTION OF THE DRAWINGS

Embodiments of the invention will now be described in more detail with reference to the drawings. In the drawings.

DESCRIPTION OF THE PREFERRED EMBODIMENTS

Figure 1:
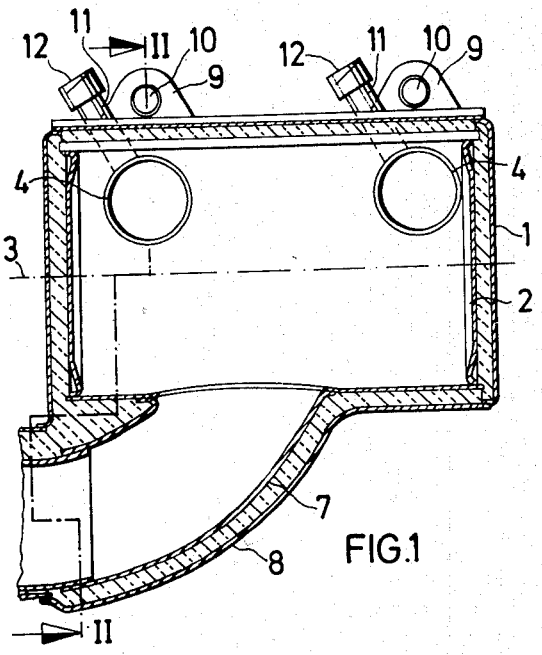
FIG. 1 shows a section of one embodiment of a reactor according to the invention, taken at the line 1—1 in FIG. 2.
Figure 2:
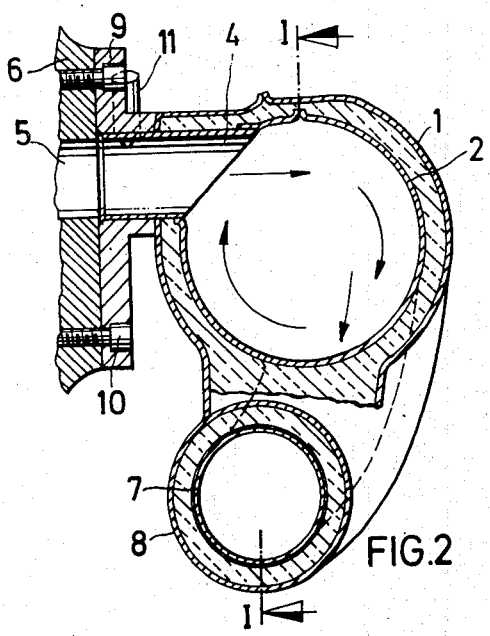
FIG. 2 shows a cross-section of the reactor at the line 2—2 in FIG. 1.

The reactor for an internal combustion engine as represented in FIGS. 1 and 2 consists of a heat-insulated, sugstantially cylindrical and smooth-walled reactor chamber 2 surrounded by a jacket 1. In this embodiment, two inlet pipes 4 open tangentially, side-by-side in the direction of the axis 3 into chamber 2. The inlet pipes 4 pass through the jacket 1 and each communicate with an outlet passage 5 of an engine 6 partially indicated in FIG. 2. Out of the reactor chamber 2, about perpendicular to it, passes an outlet pipe 7, tangentially in the direction of flow but offset from the two inlet pipes 4 and arranged between them substantially in the middle of the reactor chamber 2. The outlet pipe is likewise surrounded by a corresponding heat-insulated continuation 8 of the jacket 1, and turned aside in its further course in this embodiment. In the vicinity of the inlet pipes 4, the reactor is in close contact with the engine 6, being fastened to the engine 6 by screws 10 with the aid of a flange 9 arranged substantially parallel to axis 3. Each inlet pipe 4 is entered by a line 11 with a check valve 12 fitted to its outer end for self-aspiration of secondary air, consisting in this example of a conventional leaf spring valve, schematically shown in partially open condition.

When the engine 6 is running, exhaust gas passes through the outlet passages 6 into the reactor chamber 2, and owing to the tangential arrangement of the inlet pipes 4, very shortly strikes the wall of the reactor chamber 2 in two streams, thus rapidly heating the walls over a large area, while at the same time the exhaust is deflected by the curvature of the cylindrical wall of the reactor chamber 2 and executes a gyrating vortex motion along it, as indicated by the arrows in FIG. 2. The negative pressure waves of the exhaust gas flowing through the inlet pipes 4 enable secondary air to be aspirated through line 11, so that the reaction may set in simultaneously with the mingling commencing at this point, and be completed in consequence of subsequent swirling in the reactor chamber and thorough intimate mixture. Since the outlet passage 7 is arranged in the middle of the reactor chamber 2 and the tangential inlet pipes 4, viewed in axial direction 3, are offset ahead of and behind the outlet pipe 7, the exhaust will first gyrate helically in the reactor chamber 2 several times, before escaping through the outlet pipe 7 without changing its direction of flow.

Figure 3:
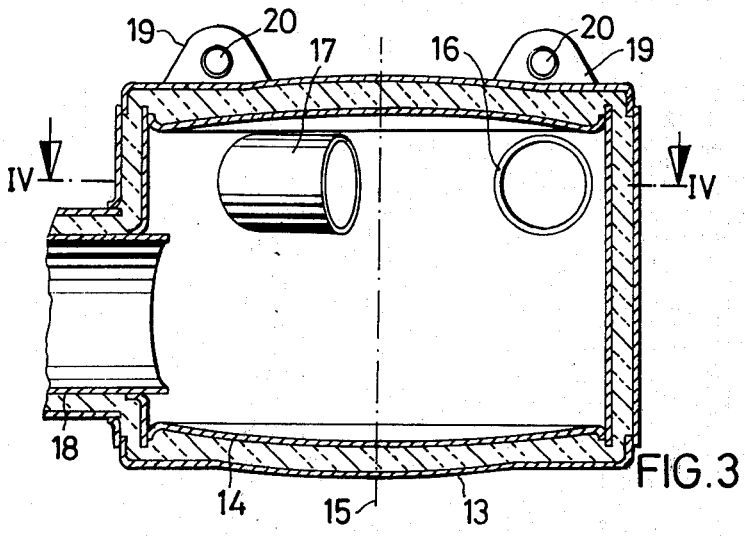
FIG. 3 shows a section of another embodiment of a reactor at the line 3—3 in FIG. 4.
Figure 4:
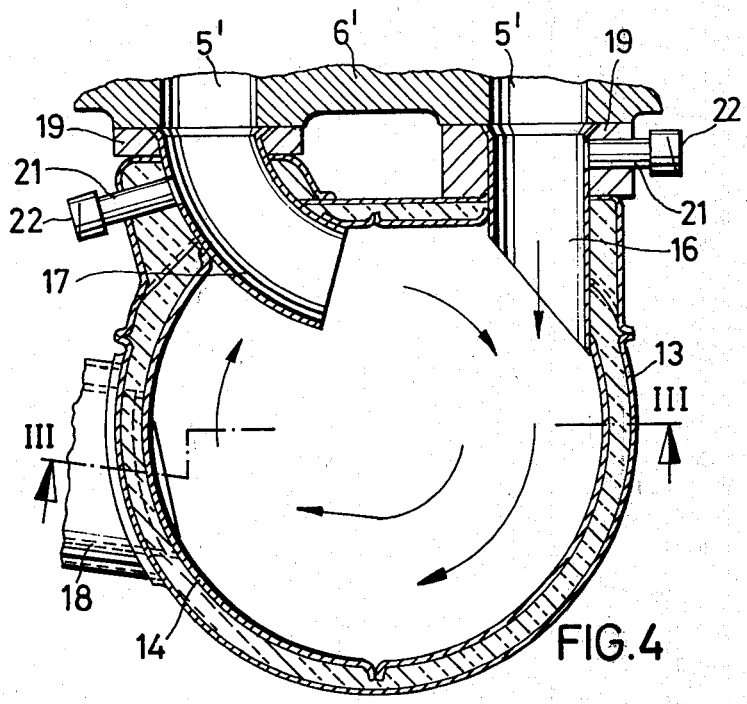
FIG. 4 shows a cross-section of the reactor at the line 4—4 in FIG. 3.

The reactor shown in FIGS. 3 and 4 for an internal combustion engine likewise consists of a heat-insulated and substantially cylindrical reactor chamber 14 surrounded by a jacket 13, the axial direction 15 of which chamber is such, relative to the embodiment of FIGS. 1 and 2, that two outlet pipes 16 and 17 tangentially enter the reactor chamber 14 successively in circumferential direction. The two inlet pipes 16 and 17 in this embodiment likewise pass through the jacket 13 and are each connected to an outlet passage 5′ of an engine 6′ partially indicated in FIG. 4. Whereas inlet pipe 16 tangentially enters the reactor chamber 14 directly, inlet pipe 17 enters the reactor chamber 14 arcwise, providing a tangential port and a compact, space-saving design. As FIG. 3 shows, the inlet pipes 16 and 17 enter the cylindrical reactor chamber 14 at the top, while the outlet pipe 18 leaving the reactor chamber 14 tangentially perpendicular to the axis lies in the direction of flow, but at the bottom. In the region of the inlet pipes 16 and 17, the reactor is in close contact with the engine 6', and is attached to it with bolts 20 by a flange 19 arranged more or less perpendicular to the axis 15. The two inlet pipes 16 and 17 are entered by connections 21 each having a conventional check valve 22 at the outer end, for self-aspiration of secondary air.

When the engine 6' is started, exhaust passes through outlet passages 5' into inlet pipes 16 and 17, which set it in a gyrating motion, indicated by arrows in FIG. 4, owing to their tangential entry ports in the reactor chamber 14. At the same time, the negative pressure waves of the exhaust gas passing though inlet pipes 16 and 17 aspirate secondary air through connections 21, so that the exhaust gases begin to react at this early point. Owing to the swirling of the two merging streams of exhaust, they are thoroughly mixed with the aspirated secondary air and the wall of the reactor chamber 14 is heated rapidly, the inlet pipe 17 incorporated in the reactor chamber 14 providing an additional mixing action. Before the exhaust leaves the reactor chamber 14 through the outlet pipe 18, the flow is positively guided helically several times around inside the chamber 14 without change of direction.

Figure 5:
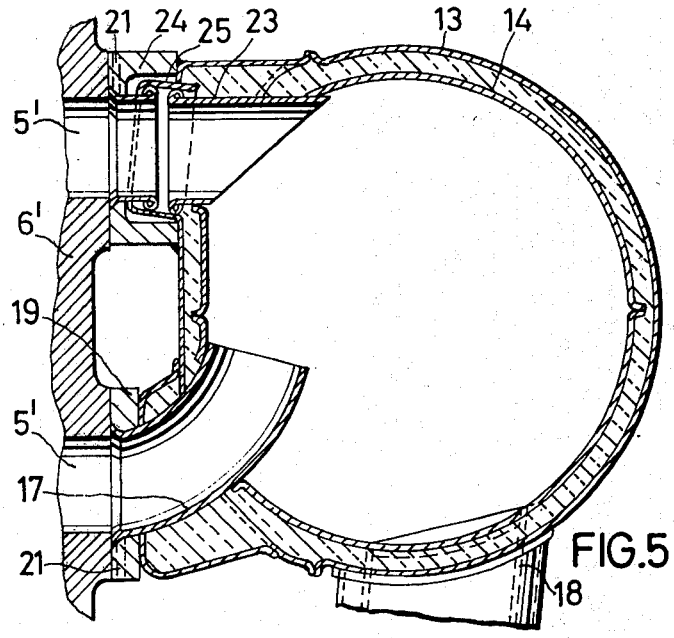
FIG. 5 shows a cross-section of the reactor at the line 4—4 in FIG. 3, where, in departure from the embodiment of FIGS. 3 and 4, one inlet pipe is of movable construction.
Figure 6:
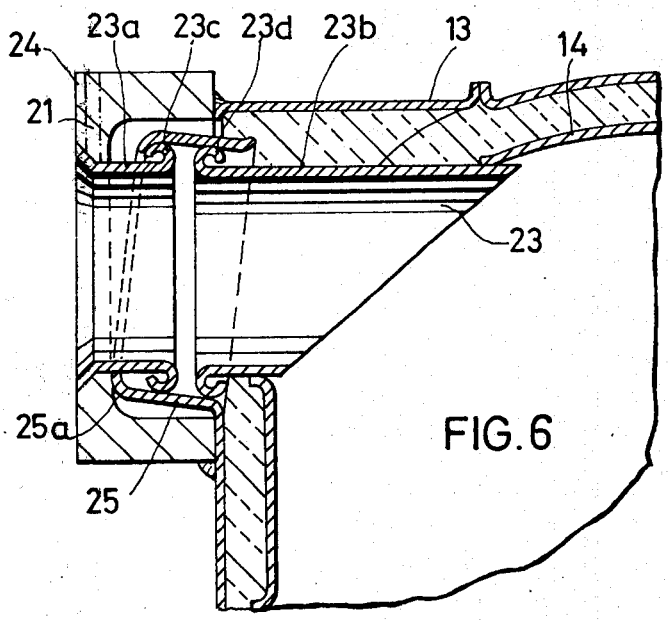
FIG. 6 shows a section of the portion of the reactor of FIG. 5 with movable inlet pipe to a larger scale.

In the embodiment represented in FIGS. 5 and 6, the same reference numerals have been used for like or similar parts as in FIGS. 3 and 4. In departure from the embodiment of FIGS. 3 and 4, the inlet pipe 23 consists, according to the invention, of two segments **23*a* and 23*b* in series, segment 23*a* being attached to the jacket 13 by a flange 24 mounted on the engine 6', and segment 23*b* to the reactor chamber 14. The two segments 23*a* and 23*b* are rolled outward at their facing ends 23*c* and 23*d* to provide a line of contact and to increase stability under strain. In contact with the outer periphery of the two rolled ends 23*c* and 23*d* there is a movable sleeve 25 overlapping the two ends 23*c* and 23*d* and sealing segments 23*a* and 23*b* together. To keep the movable sleeve 25 from slipping off the ends 23*c* and 23*d*, the sleeve 25 is provided at the end 25*a* engaging segment 23*a* with a smaller diameter than the outside diameter of the rolled end 23*c* of segment 23*a***.

When the engine 6' is running, exhaust flows through the outlet passages 5' of the embodiment of FIGS. 5 and 6 and inlet pipes 23 and 17 into the reactor chamber 14, this exhaust first heating the inlet pipes 23 and 17 and the segments **23*a* and 23*b* (FIG. 6). This heating of segments 23*a* and 23*b* causes them to expand, so that their ends 23*c* and 23*d* bear harder on the inside wall of sleeve 25. Since the sleeve 25 is not acted upon directly by hot exhaust gas, it will expand less thereby providing a dependable sealing contact. Escape of exhaust gas through the gap left at ends 23*c* and 23*d* between the reactor chamber 14 and jacket 13 as well as any rattling noise is thus largely prevented. Aspiration of heat-insulating material, provided for example between reactor chamber 14 and jacket 13, by the pulsating exhaust gases, is likewise prevented. The reactor chamber 14, further heated later on by the exhaust gases, will expand so to shift the segment 23*b* connected to the reactor chamber 14. Although segment 23*b* is able to shift relative to segment 23*a* in several planes, the articulation formed by sleeve 25 with ends 23*c* and 23*d* is maintained at all times. Thus a yielding communication with dependable sealing function is assured in all positions of sleeve 25**.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. Reactor for afterburning of unburned constituents in the exhaust of an internal combustion engine comprising; a heat-insulated reactor chamber surrounded by a jacket, two inlet pipes passing through the jacket opening tangentially into the chamber and communicating with an outlet passage of the engine, and traversed by exhaust gases mixed with secondary air, and an outlet pipe for exit of exhaust gases from the reactor chamber, the reactor chamber being cylindrical in shape, the inlet pipes entering the reactor chamber tangentially and successively in circumferential direction of the cylindrical reactor chamber, and the outlet pipe being passed out of the reactor chamber tangentially, offset from the inlet pipe in the direction of flow, one of the two inlet pipes consisting of two segments in series, one connected to the jacket and the other to the reactor chamber, the two being sealingly joined together by a sleeve movably overlapping the adjoining ends of the two segments.

2. Reactor according to claim 1, characterized in that the two segments are rolled outwardly at their facing ends and the outer periphery of the rolled ends is in contact with the inside wall of the sleeve.

3. Reactor according to claim 2 characterized in that the sleeve is of smaller diameter at the end overlapping the segment connected to the jacket than the outside diameter of the rolled end of that segment.

* * * * *